US008047978B1

(12) United States Patent
Haroldsen et al.

(10) Patent No.: US 8,047,978 B1
(45) Date of Patent: Nov. 1, 2011

(54) HIGH THROUGHPUT CHEMICAL MUNITIONS TREATMENT SYSTEM

(75) Inventors: Brent L. Haroldsen, Manteca, CA (US); Jerome H. Stofleth, Albuquerque, NM (US); John E. Didlake, Jr., Livermore, CA (US); Benjamin C-P Wu, San Ramon, CA (US)

(73) Assignee: Sandia Corporation, Livermore, CA (US)

( * ) Notice: Subject to any disclaimer, the term of this patent is extended or adjusted under 35 U.S.C. 154(b) by 590 days.

(21) Appl. No.: 12/260,645

(22) Filed: Oct. 29, 2008

Related U.S. Application Data

(60) Provisional application No. 61/001,264, filed on Oct. 30, 2007.

(51) Int. Cl.
*B09B 1/00* (2006.01)

(52) U.S. Cl. ..... 588/249.5; 588/401; 588/900

(58) Field of Classification Search ..... 588/401, 588/900, 249.5, 249, 251, 259, 260, 261
See application file for complete search history.

(56) References Cited

U.S. PATENT DOCUMENTS

| | | | |
|---|---|---|---|
| 6,881,383 | B1 | 4/2005 | Tschritter |
| 7,186,877 | B1 | 3/2007 | Morrissey |
| 7,495,145 | B1 | 2/2009 | Doyle, III et al. |

*Primary Examiner* — Edward Johnson
(74) *Attorney, Agent, or Firm* — Timothy Evans

(57) ABSTRACT

A new High-Throughput Explosive Destruction System is disclosed. The new system is comprised of two side-by-side detonation containment vessels each comprising first and second halves that feed into a single agent treatment vessel. Both detonation containment vessels further comprise a surrounding ventilation facility. Moreover, the detonation containment vessels are designed to separate into two half-shells, wherein one shell can be moved axially away from the fixed, second half for ease of access and loading. The vessels are closed by means of a surrounding, clam-shell type locking seal mechanisms.

10 Claims, 4 Drawing Sheets

HIGH THROUGHPUT CHEMICAL MUNITIONS TREATMENT SYSTEM

CROSS REFERENCE TO RELATED APPLICATIONS

This application claims the benefit of the filing date of U.S. Provisional Application 61/001,264, filed Oct. 30, 2007, entitled "High Throughput Chemical Munitions Treatment System", and herein incorporated by reference in its entirety.

STATEMENT OF GOVERNMENT INTEREST

This invention was made with Government support under government contract no. DE-AC04-94AL85000 awarded by the U.S. Department of Energy to Sandia Corporation. The Government has certain rights in the invention, including a paid-up license and the right, in limited circumstances, to require the owner of any patent issuing in this invention to license others on reasonable terms.

FIELD OF THE INVENTION

The present invention relates to improved methods and devices for safely treating, neutralizing, and disposing of chemical munitions and other similarly toxic and/or dangerous materials. More particularly, the present invention relates to a transportable, high throughput facility capable of semi-continuous operation.

BACKGROUND AND RELATED ART

Recent attention to buried chemical weapon materiel has highlighted the need for remediation systems to destroy recovered chemical warfare materiel (CWM) at a substantially faster rate than can be done with systems currently used by the Project Manager for Non-Stockpile Chemical Materiel (PM NSCM). The attention has highlighted the fact that the PM NSCM's inventory of mobile remediation systems—the Explosive Destruction System (EDS) and the Rapid Response System (RRS)—were originally designed to address only small volumes of recovered CWM. These systems have worked very well and have achieved a significant degree of acceptance with the public and within the regulatory community. However, the near continuous use of the existing four EDS platforms and the extension of the Chemical Weapon Convention deadlines have shown the throughput of these systems is inadequate to address many of the identified CWM disposal/burial sites.

Devices for safely handling explosives are well known in the art. For example, Fylling, in U.S. Pat. No. 3,820,479, describes a mobile container in which an explosive, such as a time bomb, can be placed after discovery for transport to a suitable location for disarming. In includes a ballistic grille to vent explosion gases in an upwardly direction. Hickerson, in U.S. Pat. No. 4,027,601, describes a container for explosive devices that includes inner and outer cylinders to substantially contain detonation fragments and the blast. This device is intended to transport improvised explosive devices (IEDs) or homemade bombs to a safe disposal area. Benedick et al., in U.S. Pat. No. 4,055,247, describes an explosive storage container designed to absorb and contain the blast, fragments, and detonation products from an unintentional detonation of the contained explosive or munition. Here again, the device is designed to safely transport and store a munition and includes distinct layers to absorb the explosive energy. All of these devices are intended to provide a safe means for transport and/or storage of an explosive, but none are designed for purposeful detonation in order to destroy the explosive, and none are gas-tight or otherwise designed to treat toxic or hazardous chemical payloads.

Holmlund et al., in U.S. Pat. No. 4,478,126 describes a chamber for containing the effects arising from explosions or detonations whether initiated intentionally or unintentionally inside the chamber. The chamber comprises a cylindrically formed mantle with associated sealed ends. Ohlsson, in U.S. Pat. No. 4,478,350, describes a spherical container or chamber to protect the surroundings by containing critical stages in the manufacture of explosives, or to store or serve as a bunker for explosives. Ohlson, in U.S. Pat. No. 4,621,559, describes a readily replaceable liner to be used in detonation chambers and capable of receiving fragments to mitigate the effects of splinters produced by explosions, and in which only damaged parts of the liner need to be replaced; and Ohlson, in U.S. Pat. No. 4,632,041, describes a cylindrical blasting chamber which can contain high pressure and splinters produced by an explosion. The blasting chamber includes a double-wall design such that explosive pressure is distributed fairly evenly between the inner and outer walls. However, these devices are not intended to be used for the safe detonation and chemical treatment of explosively configured chemical warfare munitions.

Donovan, in U.S. Pat. Nos. 5,613,453, 5,884,569, 6,173,662, and 6,354,181 describes methods and an devices for containing and suppressing explosive detonations, whether for the explosive working of metals or for the disposal of unwanted explosive munitions. The apparatus includes a linear array of vent pipes to vent the explosions' gaseous combustion products for subsequent treatment in a scrubber. This apparatus includes a double-walled steel explosion chamber anchored to a concrete foundation, and double-walled access and vent doors. Energy absorbing means such as water-filled bags and conventional chain blast mats are also employed. This device is not intended to be readily mobile, is not equipped for chemical neutralization, nor is it gas-tight so that it can safely contain toxic chemical warfare agents and byproducts.

Explosive chambers have also been developed for controlling and suppressing the detonation of explosives used for industrial applications such as surface hardening of manganese steel rail, welding of metallic components, and compression molding of components from powders. Most of these applications permit the release of the explosion combustion products into the atmosphere. See, for example, U.S. Pat. Nos. 5,419,862 and 4,100,783 issued to Hampel and Gambarov, respectively. Dribas in U.S. Pat. No. 4,085,883 and Minin in U.S. Pat. No. 4,081,982 disclose spherical containment vessels for explosive working of metals, the latter also including an internal liquid spray for neutralizing toxic byproducts of the explosion. Here again, these devices are intended to explosively work or harden a workpiece, are not intended to access the interior of the workpiece or otherwise destroy it, and are not gas-tight or otherwise suitable for disposal of chemical warfare munitions.

Sandia National Laboratories developed the EDS for PM NSCM in the late 1990s to provide a self-contained, transportable capability to remediate small volumes of non-stockpile chemical munitions at recovery sites. The technology is summarized in U.S. Pat. No. 6,188,338, to Tschritter, et al., herein incorporated by reference in its entirety, as is a list of the constituents known to have been used in CWM weapons as are the commonly known remediation solution media. The EDS has proven to be a flexible, capable, effective, and regulatory acceptable system to meet PM NSCM's mission requirements as these requirements were understood in the late 1990s. The successful operation of the EDS, and a subsequently larger, second generation version of EDS, has proven the core technology, but neither system was designed for high throughput or large quantity operations. Moreover, these systems do not disclose a separate waste treatment system, nor do they disclose an explosive containment vessel comprising two side by side cylindrical cups and a center seal system, nor do they disclose a semi-permanent fragmentation suppression system does the present invention, no is a semi-continuous batch operation anticipated by either. Consequently, neither can meet the emerging needs for expected higher volume processing. However, the current limited process rate is not inherent in the EDS technology. It is entirely feasible to build a much faster system while retaining the proven benefits of the EDS process.

In view of the foregoing, and the enormous need for remediation of obsolete, decaying, and degraded munitions it is highly desirable to provide an apparatus which can be used to dispose of chemical warfare munitions in a safe and rapid industrial basis.

SUMMARY

As first envisioned, the EDS had a specific mission which was to chemically treat chemical munitions in emergency scenarios where the munition was not safe to transport or store. As such, EDS was to fill a critical, but limited role with no more than one or two uses per year. Since that time, the role for EDS within the non-stockpile program has expanded substantially.

Consistent with its intended application, the EDS design emphasized transportability, flexibility, redundancy, surety of destruction, and the simplicity of manual operation. There was no emphasis on process time or throughput. Recently there has been much discussion about the need for systems with higher throughput for potential applications such as large CWM disposal/burial sites. In this context, some other technologies appear to offer advantages compared to the existing EDS. In fact, the EDS process is not inherently slow. Therefore, a new High Throughput Explosive Destruction System (HTEDS) is described herein which would provide an order of magnitude increase in throughput while maintaining all of the attributes and strengths that have made EDS successful. Besides increasing capacity, the HTEDS would reduce operator effort, increase capability in terms of the types and sizes of munitions, reduce effluent, and reduce unit cost of munitions disposal.

In response to this growing need the HTEDS will be designed with a 20-fold increase in capacity. The system optimizes proven EDS technology to achieve the following:

- Process up to 60 munitions per day;
- Increase the size of the munitions that can be treated;
- Improve the instrumentation and automation to reduce operator workload;
- Maintain transportability and ease of set-up/tear-down operations; and
- Maintain the proven explosive access and chemical treatment process that has achieved public and regulatory acceptance.

The projected 20-fold increase in throughput, however, considers only the results of optimizing the EDS design to form the HTEDS. Additional efficiencies would be created through enhancements to the overall site remediation operation achieved by applying a "system of systems" approach. This approach considers all aspects of the operation from site characterization to final waste disposal including locating, characterizing and removing buried munitions; storage of munitions and explosives; munition destruction; monitoring and process control; and generation and disposal of dunnage or secondary waste. The result is an optimization of the entire process in terms of safety, throughput, and cost. Various technologies can be applied in a system of systems approach to move munitions seamlessly through the process.

Accordingly, it is an object of the present invention to provide a CWM remediation system for safely opening and neutralizing chemical munitions, the system comprising at least two sealable explosive containment vessels and a separate waste treatment vessel and means for circulating a waste remediation fluid between the containment vessels and the waste treatment vessel.

It is also an object of the present invention to provide a CWM remediation system that can operate on a semi-continuous basis.

It is another object of this invention to provide sealable explosive containment vessels comprising first and second cylindrical "cups" or shells wherein the cups or shells are disposed horizontally to one another with their open ends facing each other, and wherein one of the cups or shells is easily moved, in an axial direction, toward or away from the other cup or shell.

It is still another object of this invention to provide a circumferential "clam-shell" or "hoop" clamp for closing and sealing the first and second cups or shells.

It is yet a further object to provide a CWM remediation system comprising a ventilation chamber surrounding the containment vessels.

It is again an object of this invention to provide a CWM remediation system comprising containment vessels having an improved, semi-permanent fragmentation suppression system.

The foregoing and other objects and advantages of the present invention will appear from the following detailed description. Both the foregoing general description and the following detailed description are exemplary and explanatory only and are intended to provide further explanation of the invention as claimed. In the description, reference is made to the accompanying drawings which form a part hereof, and in which there is shown by way of illustration and not limitation, preferred embodiments. Such description does not represent the full extent of the invention, but rather the invention may be employed in different arrangements or configurations according to the breadth of the invention as defined in the appended claims.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF AN EMBODIMENT OF THE INVENTION

The core process steps for the HTEDS are generally the same as those used for the proven second generation EDS:

- Munitions are bundled with explosive shaped-charges and inserted into a containment vessel;
- The containment vessel is sealed and the shaped charges are detonated to open the munitions and destroy the bursters (an explosive charge located within the munition used to disseminate the CWM agent);
- The CWM thus released is treated using established chemical treatment or "neutralization" protocols;
- The effluent is removed for final disposal; and
- The system readied for the next batch of munitions.

The HTEDS, however, achieves greater throughout in several ways: (1) detonation and subsequent chemical treatment are performed in at least two separate explosive containment vessels in a semi-continuous batch mode by alternating operations between each of the two vessels; (2) the detonation containment vessels are larger to allow for processing more munitions at one time; (3) the chemical agents contained within the munitions are treated in a separate waste treatment vessel in a semi-continuous batch mode, thereby freeing up the detonation containment vessels to process additional munitions and thereby eliminating the need for the current complex rotating containment vessel; and (4) various sealing components including the vessel seal and the valve panel have been redesigned to reduce the time needed for each step and allow the operators to work more efficiently.

Figure 1A:
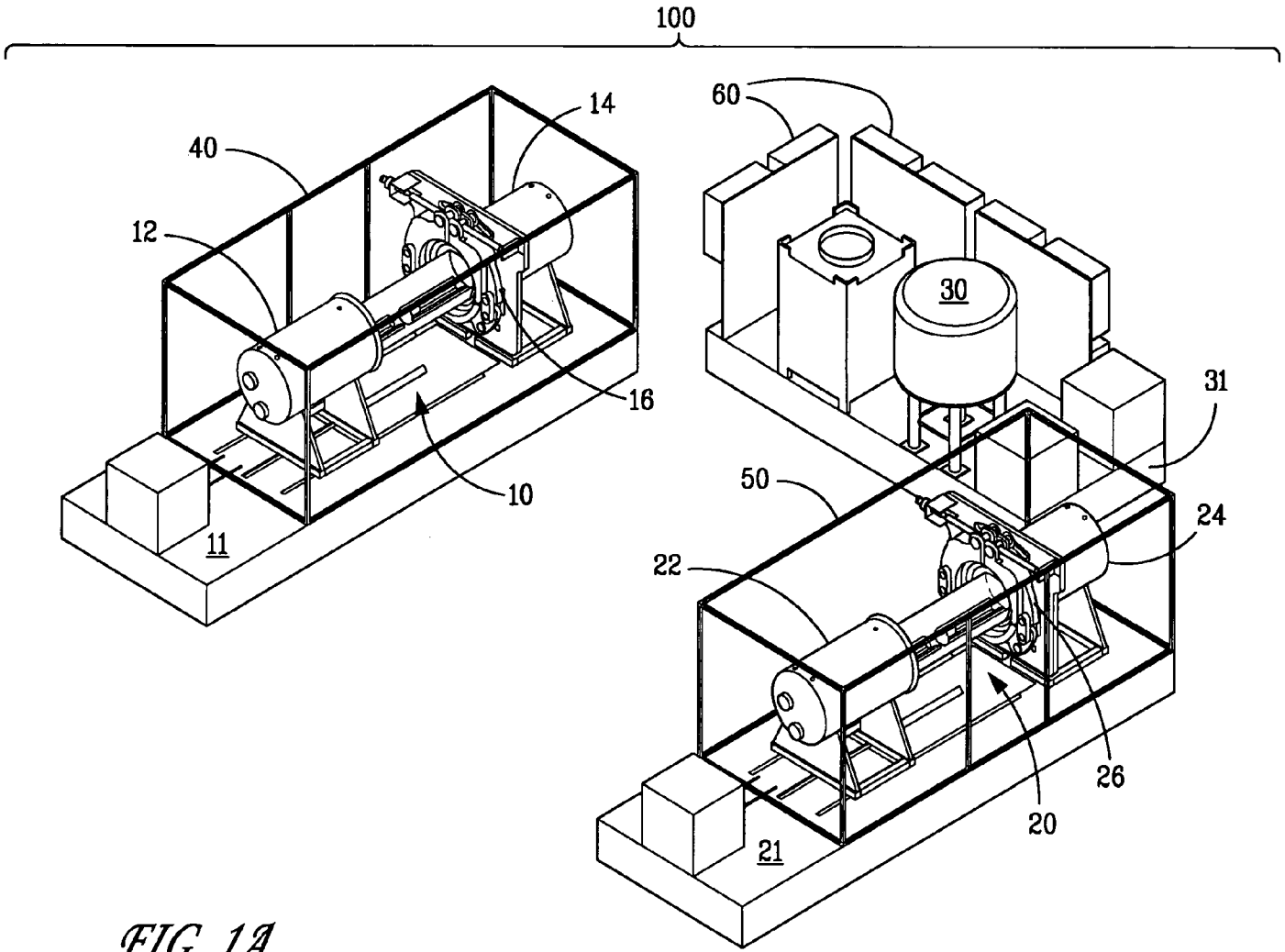
FIG. 1A shows a cartoon layout of an embodiment of the HTEDS as described by herein.
Figure 1B:
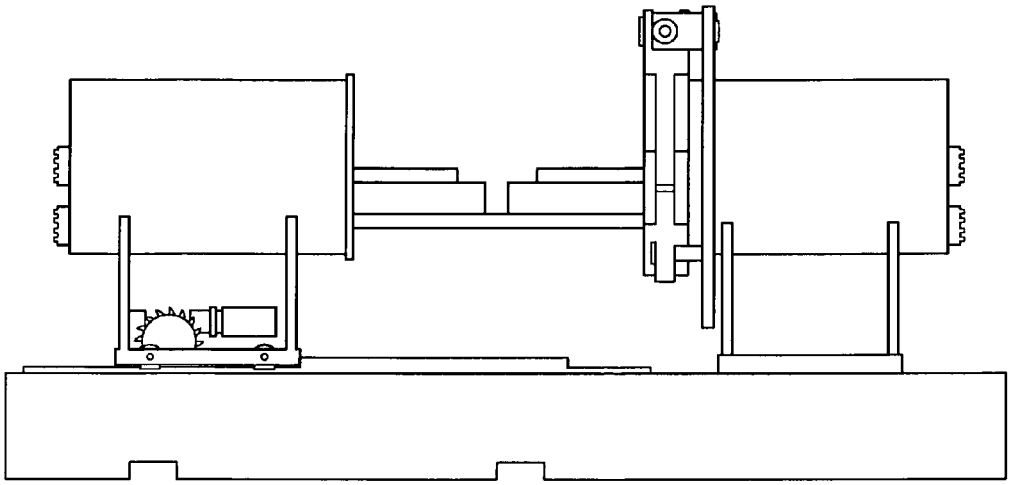
FIG. 1B shows a cartoon side view of one of the two two-piece containment vessels in the open, separated state ready for loading.
Figure 1C:
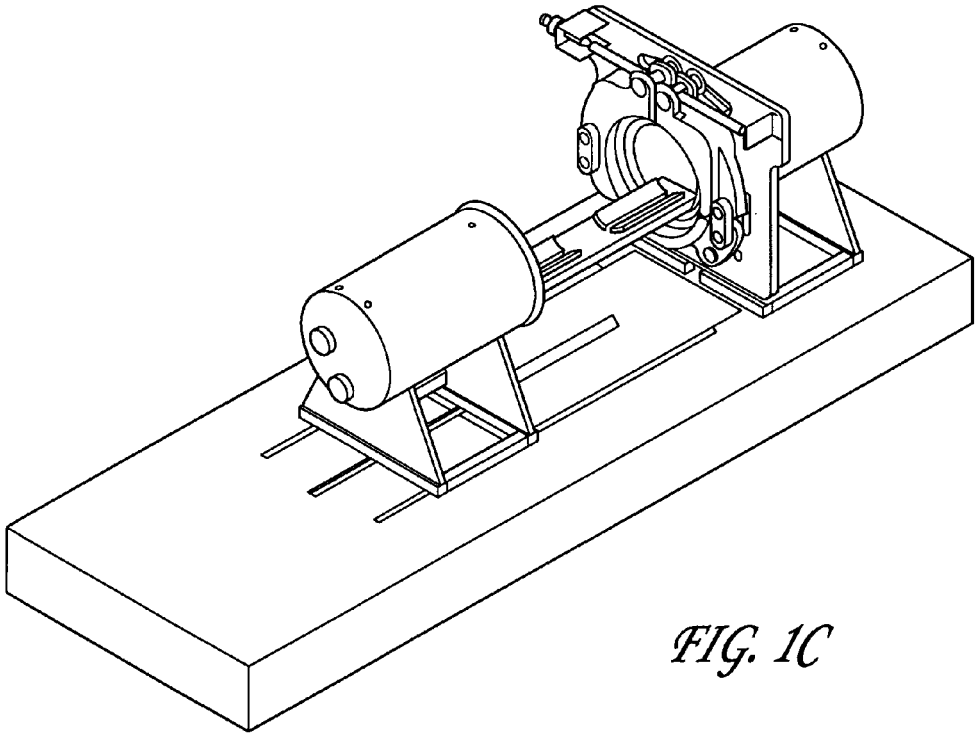
FIG. 1C shows an over-head view of the two two-piece containment vessel.

FIG. 1A show the proposed layout of a preferred embodiment of the HTEDS as it is currently envisioned, HTEDS 100 would comprise two side-by-side detonation containment vessels 10 and 20, each comprising respective first and second cylindrical halves or "shells" 12 and 14, and 22 and 24 that are fluidly linked and feed into a single chemical agent treatment vessel 30. Detonation containment vessels 10 and 20 are designed, as shown in FIGS. 1B and 1C, so that front halves 12 and 22 (latter not shown) can be moved axially away from their respective rear halves 14 and 24 (latter not shown) which remain fixed. Both halves further comprise a sealing edge or flange at their open ends about which clam-shell type seal mechanisms 16 and 26 (latter not shown) is introduced and through which the two halves or "shells" are closed and sealed with the aid of a separate metal gasket placed between the flanges.

This "two-shell" design represents a significant departure from the current EDS in that the design of the prior art containment vessel utilized a thick-walled cylinder with a swing-open door. In particular, the HTEDS layout and process sequence allows the operation of the two containment vessels in an alternating manner by a single crew performing critical operations on only one vessel at a time. The process of closing and sealing the vessel is a time consuming element of current operations with the existing EDS which requires reaching into the vessel to place the CWM selected for disposal, aligning and closing the door, and then securing the door with several large individual clamps and a metal gasket. In contrast, the HTEDS containment vessel comprises two cylindrical shells placed end-to-end with a seal and closure clamp system in the middle. Instead of a swing-open door, the two cylindrical pieces would spread apart axially providing for ease of loading.

In addition, each of the two containment vessels 10 and 20 is surrounded by a separate ventilation means such as fume hoods 40 and 50 used to reduce the possibility of operator exposure to toxic agents and noxious fumes. As shown in FIG. 1A, HTEDS 100 is also mounted on several skids 11, 21, and 31, wherein skids 11 and 21 respectively hold detonation containment vessels 10 and 20 together with their respective ventilation units 40 and 50, while skid 31 holds chemical agent treatment vessel 30 together with the associated fluid handling hardware (not shown) and HTEDS controls 60. The skids eliminate the cost and complexity of the specialized trailer used with the second generation EDS but can be easily transported on several flatbed trucks so they have little impact on transportability. Furthermore, connections between the skids are minimal so there is little impact on setup time and because everything is located close to the ground the equipment and controls are all easily accessible to the operations personnel eliminating much of the need for lifting munitions and heavy hardware.

Figure 2:
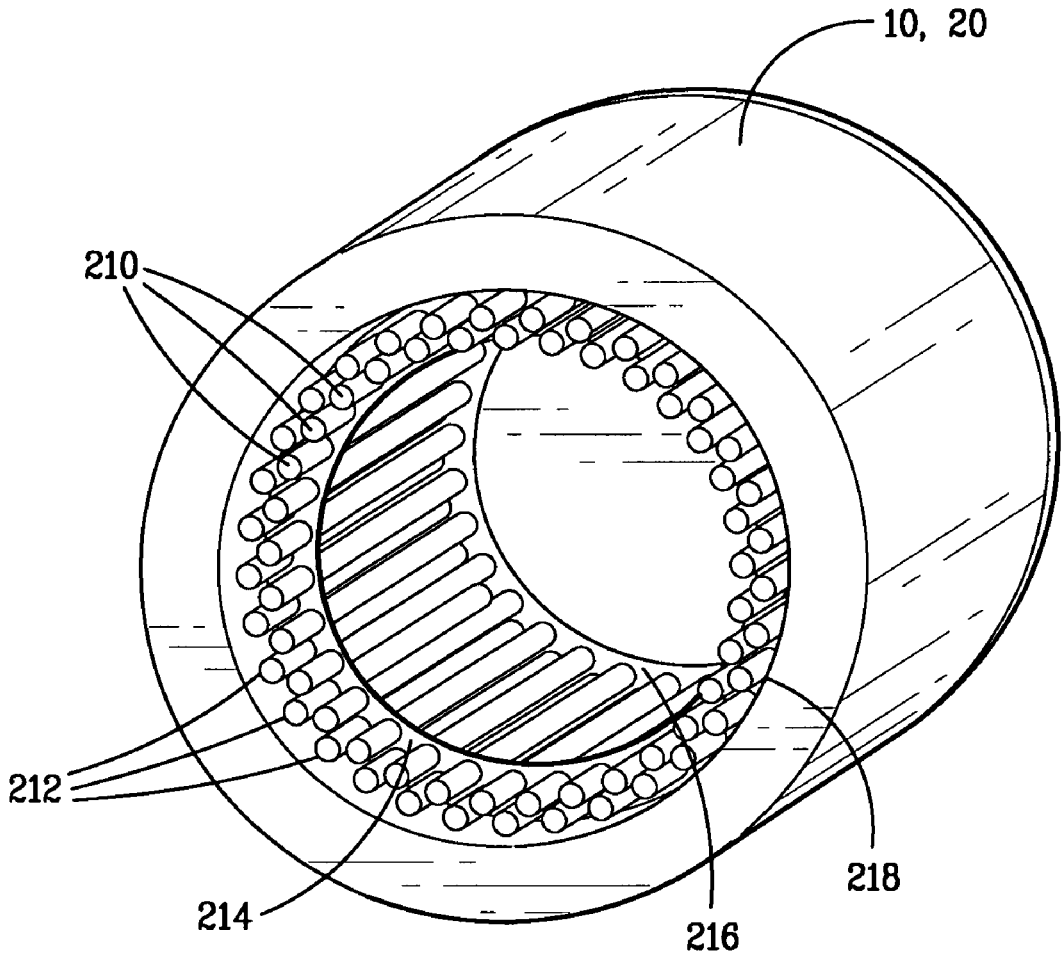
FIG. 2 shows a view of the interior of one of the two halves of the containment vessel containing the improved fragmentation suppression system.

Lastly, the HTEDS further comprises an improved fragmentation suppression system detailed in commonly-owned U.S. patent application Ser. No. 12/199,340, filed Aug. 27, 2008, entitled "Fragment Capture Device," and herein incorporated by reference. The improved fragmentation suppression system, shown in FIG. 2, is generally comprised of at least two concentric and overlapping rows of steel rods 210 and 212 disposed about the interior circumference 218 of each of the first and second containment shells and held in place by positioning plates 214 and 216. The rods are removable but are intended to be attached to the interior on a semi-permanent basis.

Several significant design changes have been made to distinguish the HTEDS over the prior art EDS. The first and probably most significant change is the incorporation of a separate treatment vessel to treat the chemical agent(s) associated with the CWM. The keys to implementing the proposed semi-continuous bath approach is the ability to knock down vapor phase agents generated within the two containment vessels 10 and 20 after opening the CWM and the ability to effectively transfer the contents of the containment vessels into chemical agent treatment vessel 30. This is done by injecting hot water containing neutralizing reactant chemicals from chemical agent treatment vessel 30 directly into the interior of containment vessels 10 and 20 through a fluid manifold and a series of spray nozzles built into the ends of each of these vessel such that a high pressure spray is used to provide vapor "knockdown" within the vessels and to scrub the interior surfaces of the vessels, their interior hardware and all fragments of the CWM itself. Steam is also used to both heat the aqueous solution and to act as a solvent agent to solubilize and remove into solution toxic residues within the containment vessels and on the munition fragments.

A closed loop recirculation path using a "canned-motor" pump, such as the CPXR recessed impeller pump available from the Flowserve Corporation (Irving, Tex.), or the MAXP series of pumps available from MAGNATEX Pumps Inc., (Houston, Tex.), ensures total containment at all times. Canned motor pumps are used routinely for pumping hazardous fluids and are able to handle slurries and particulate laden fluids at temperatures, pressures, and volumes appropriate for this application.

Finally, after the solution of neutralizing chemicals are injected into one of the containment vessels the vessel is left to soak for period of time before the fluid is drained and pumped back to the treatment vessel where it is left overnight for further reaction.

In designing the HTEDS, it is important to establish how clean the containment vessel needs to be before it is open to load the next munitions. The most time consuming step in the current process is a hot water rinse required to decontaminate the vessel to below a predetermined detection level. The hot water removes small residues of polymerized agent(s) or "heel" from aged munitions that survives the normal treatment process. Repeated decontamination to this level is consistent with the expectation of treating a single munition and moving on. However, in a high-throughput scenario with back-to-back operations, this level of decontamination is only required at the end of a campaign or, at most, at the end of each day. Since the HTEDS vessel is secondarily contained in a fume hood, residual concentration between batches of a few TWA from agent heel should be acceptable.

However, even if the hot water/steam rinse is not done after each detonation, it is still a required operation at the end of a campaign, and perhaps more frequently. Instead of pumping in warm water and heating it in the vessel which takes several hours, the HTEDS also uses a steam generator to inject steam into the vessel either separately or in combination with the liquid neutralizing stream. The steam attacks the residual heel more effectively than hot water, it heats the vessel from the inside more quickly and efficiently than external heaters as are now used, and it contacts all vessel surfaces.

Related to the use of a separate treatment tank is a second significant difference between the HTEDS and the current EDS: the elimination for the need to rotate the primary detonation containment vessel. In the prior art system, the chemical treatment of the contents of the munition is performed within the detonation containment vessel after the CWM had been "cut" open using shaped changes. However, using the containment vessel to treat the CWM agent and the related waste requires heating and continuously rotating the primary containment vessel in order to agitate and mix the contents of the vessel. This practice is time consuming not only due to the underlying chemical reaction time but also due to the time needed to heat the substantial mass of the vessel and its contents.

By eliminating the need for using the containment vessel to treat the chemical agent(s) removed from the CWM the design and operation of the overall system is drastically simplified since there is no need for a rotation motor, no drive train, no electrical slip ring, no trolley wheels, and no stirring blades inside the containment vessel. Furthermore, also eliminated are the various interlocks and safety features associated with adapting the containment vessel for rotation. In addition, the clamps securing the two halves of the HTEDS containment vessel do not have to be disconnected from the clamp hangers and, consequently, the vessel closure system is also simplified. Finally, fluid and electrical connections may be "hard" plumbed and wired to the vessel rather than having to use quick-connect fittings.

Because the HTEDS containment vessels does not rotate, it is possible to use a standard GRAYLOC® PRODUCTS remote clamping system available from Oceaneering International, Inc., (Houston, Tex.) to secure the vessel instead of the custom-designed sliding clamps and hydraulic nuts from second generation EDS. This eliminates the manual processes of sliding the two clamps together, tightening the hex nuts, actuating the hydraulic nuts, and securing the hex nuts, as well as the reverse processes at the end of the operation saving almost an hour in assembly time and reducing the level of effort for the operators. As already noted, instead of the hinged door, one end of the vessel rolls on rails toward and away from the other half. This also eliminates ongoing difficulties with door alignment and makes loading and unloading the vessel easier. The munitions and shaped charges are assembled on a platform or tray between the two ends of the vessel. When the vessel ends come together, the tray slides into the vessel. Similarly, during unloading operations the tray allows pulling out some large fraction of the fragments generated by opening the CWM.

A final difference is that each containment vessel is located inside a fume hood that is vented through an activated carbon filter. The hood reduces the inherent hazards associated with removing a munition from an over pack and loading it in the system, particularly if the munition is leaking. Although some operations on the second generation EDS would be more difficult in a fume hood, HTEDS alleviates these issues with a combination of design changes and remote operation.

Figure 3:
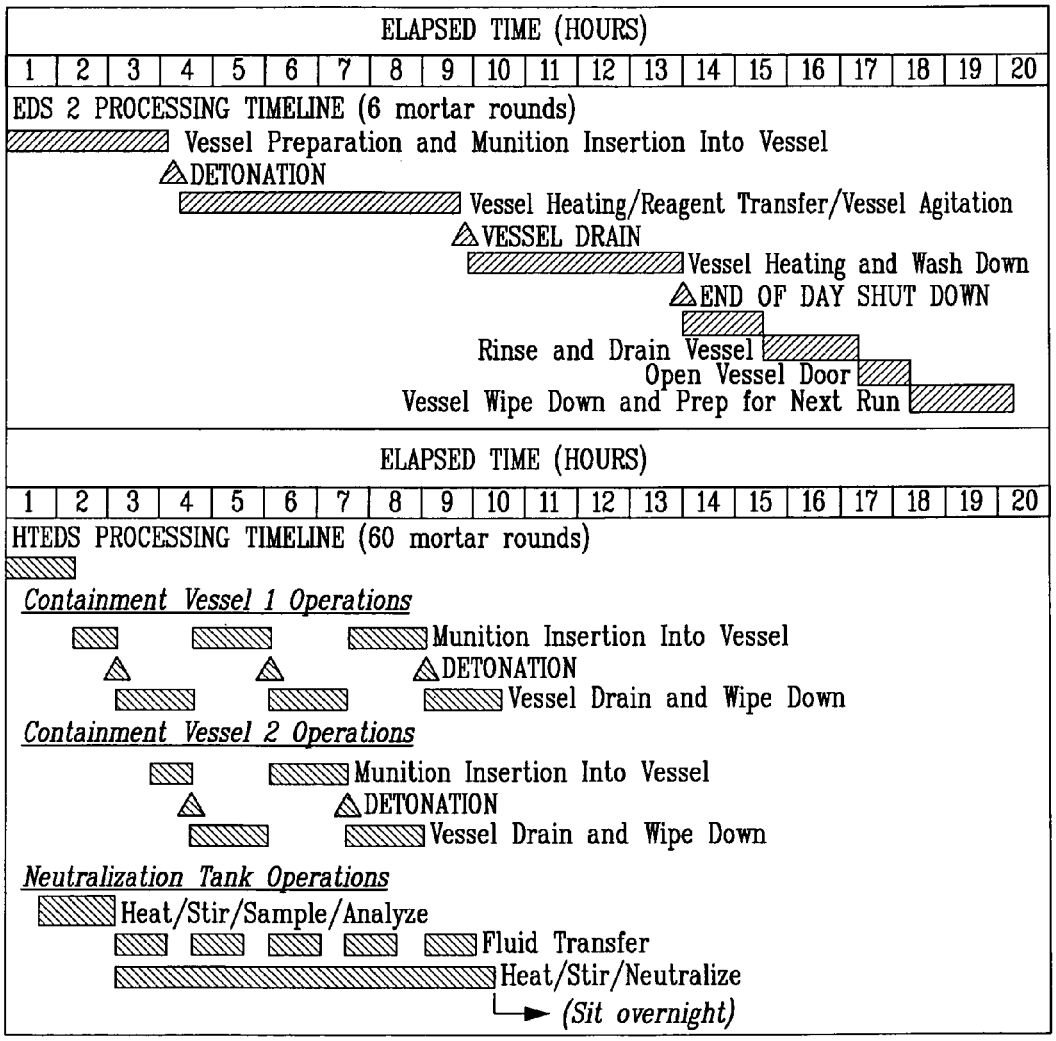
FIG. 3 show a comparison of the time needed to operate the EDS and the HTEDS through one cycle.

The timeline for the HTEDS to process sixty CWM munition rounds during a 12-hour period is illustrated in the bottom half of FIG. 3 and compared to that of second generation EDS to process only six rounds. This illustration highlights the throughput impacts of the design innovations of the HTEDS. The two detonation containment vessels are operated in parallel to enable five batches to be processed in a single 10.5-hour period. During this same period, the treatment chemistry is performed as a separate batch operation in the treatment vessel. Since the HTEDS detonation containment vessels are twice the size of the second generation EDS vessel, each can process twice the load of a single second generation EDS. Also, note that individual steps in the process are much shorter. For example, the simplified clamp for the containment vessel enables much faster closure. The combination of the fume hood surrounding the containment vessel and an innovative steam rinsing process greatly shortens the time required to prepare the vessel for the next load of munitions.

The current EDS process takes almost 20 hours over two days. The munitions are placed in the fragment suppression system with the shaped charges. The assembly is loaded into the vessel, the door is sealed, and the seal is leak tested. The shaped charges simultaneously open the munitions and destroy their bursters. Treatment or "neutralization" chemicals are then pumped into the vessel and the vessel is heated to 60° C. with external resistance heaters. Liquid samples are collected and analyzed to confirm destruction of the agent after which the effluent is drained to waste drums and the vessel is filled again, this time with water. The water is heated to 100° C. to destroy any remaining heel. During both heating steps, the vessel is continuously rotated on its axis to mix the contents and speed the reaction. After the vessel cools over night, a gas sample is collected and analyzed, the water is drained, the vessel is flushed with helium, and the vessel is opened. Solid debris is removed and the vessel is prepared for the next operation.

Therefore, having described an exemplary embodiment of the present invention, it should be noted by those skilled in the art that various other alternatives, adaptations, and modifications may be made within the scope of the present invention. Accordingly, the present invention is not intended to be limited to the specific embodiment illustrated herein, but is only limited by the following claims.

Finally, to the extent necessary to understand or complete the disclosure of the invention, all publications, patents, and patent applications mentioned herein are expressly incorporated by reference therein to the same extent as though each were individually so incorporated.

What is claimed is:

1. A semi-continuous system for remediating chemical munitions, comprising:

(a) at least two side-by-side containment vessels, each containment vessel comprising:

first and second hardened cylindrical shells, each of the cylindrical shells having a wall thickness, an interior surface, and a sealing flange disposed about an open end of the shell, wherein the open ends of each shell are disposed opposite each other, and wherein the first shell is fixed and the second shell is axially moveable horizontally with respect to the first shell;

a remote clamping system for engaging and surrounding the flange of each of the first and second shell thereby sealing the first shell to the second shell;

at least one electrical feed-through means;

inlet conduit means for receiving waste treatment reactant chemicals;

outlet conduit means for removing a liquid effluent; and (b) a waste treatment system fluidly communicating with the inlet and outlet conduit means of the two side-by-side containment vessels, the waste system, comprising:

a sealed reactant vessel comprising the waste treatment reactant chemicals;

a canned-motor pump;

a closed loop recirculating system in fluid communication with the canned-motor pump, the seal reactant vessel and the inlet and outlet conduit means of each of the two containment vessels; and (c) means for explosively opening a munition within the two side-by-side containment vessels.

2. The semi-continuous system according to claim 1, wherein the waste treatment chemicals comprise a hot aqueous solution.

3. The semi-continuous system according to claim 2, wherein the aqueous solution is heated by electrical resistance heating.

4. The semi-continuous system according to claim 2, wherein the hot aqueous solution is heated by steam.

5. The semi-continuous system according to claim 1, wherein the inlet conduit means comprises one or more spray nozzles disposed within the hardened containment vessel.

6. The semi-continuous system according to claim 5, wherein the hot aqueous solution is delivered together with the steam into the hardened containment vessels through the one or more one spray nozzles.

7. The semi-continuous system according to claim 1, wherein the remote clamping system comprises;

a trunnion and screw mechanism;

a single drive adaptable to different power means;

a self-supporting base plate; and a retained seal ring.

8. The semi-continuous system according to claim 1, wherein the canned-motor pump is a sealed impeller pump.

9. The semi-continuous system according to claim 1, further comprising an improved fragmentation suppression system, the system comprising a plurality of concentric overlapping removable rods.

10. The semi-continuous system according to claim 9, wherein the overlapping rods are disposed axially about the interior circumference of each of the first and second shells proximal to the interior surface of each shell and extending the length of each vessel.

* * * * *